US005665012A

United States Patent [19]

Bunn, III

[11] Patent Number: 5,665,012

[45] Date of Patent: Sep. 9, 1997

[54] GOLF CLUB HEAD

[76] Inventor: Julian W. Bunn, III, 1319 capital Blvd., Raleigh, N.C. 27603

[21] Appl. No.: 600,064

[22] Filed: Feb. 12, 1996

[51] Int. Cl.[6] ..... A63B 53/04

[52] U.S. Cl. ..... 473/328; 473/350

[58] Field of Search ..... 473/287, 290, 473/324, 325, 326, 327, 328, 329, 330, 331, 332, 333, 334, 335, 336, 337, 338, 339, 341, 342, 343, 344, 345, 346, 347, 348, 349, 350

[56] References Cited

U.S. PATENT DOCUMENTS 5,312,105 5/1994 Cleveland ..... 473/350

FOREIGN PATENT DOCUMENTS 2117254 10/1983 United Kingdom ..... 273/77 A

*Primary Examiner*—Sebastiano Passaniti

*Assistant Examiner*—Stephen L. Blau

*Attorney, Agent, or Firm*—Rhodes, Coats, & Bennett, LLP

[57] ABSTRACT

The present invention entails a golf club head having a face, back sole and a leading edge extending between the sole and the face. The sole is shaped such that there are three distinct and separate Surfaces defined thereon. There is an intermediate surface formed on the sole that forms a plateau. On each side of the intermediate plateau there is defined on the sole an outer surface area. One outer surface area breaks away from the plateau and extends generally upwardly towards both the leading edge and the heel of the club. The other outer surface breaks away from the plateau and extends generally upwardly towards the leading edge and the toe area of the club.

23 Claims, 5 Drawing Sheets

GOLF CLUB HEAD

FIELD OF INVENTION

The present invention relates to golf club heads and more particularly to a golf club head having a sole that includes a plurality of distinct surfaces designed to reduce drag or resistance.

SUMMARY OF THE INVENTION

Attempts at designing golf club heads that reduce drag and resistance are well-documented in the prior art. Drag and resistance come into play, for example, when the club head is swung through rough, tall grass or when the club head is brought into contact with the turf or ground. In attempting to reduce drag and resistance, one needs to be mindful of the shape of the leading edge and the surface of the sole extending away from the leading edge. This is because it is the leading edge and the adjacent area of the sole that typically comes in contact with sand, rough, tall grass and the turf or ground as the club head approaches and makes impact with the golf ball.

The present invention presents a golf club head having a face, back, sole, leading edge, toe area and heel area wherein the sole includes an intermediate surface and two flanking outer surfaces. First, the sole assumes a generally curve shape such that the two outer surfaces are elevated with respect to the intermediate surface. The intermediate surface forms a plateau on the sole and the two outer surfaces break away from the plateau and are inclined generally upwardly towards the leading edge. In addition, both outer surfaces are inclined generally outwardly with respect to the golf club head such that the surface adjacent the heel area inclines generally upwardly towards the heel area while the surface adjacent the toe area inclines generally upwardly towards the toe area.

DETAILED DESCRIPTION OF THE INVENTION

Figure 1:
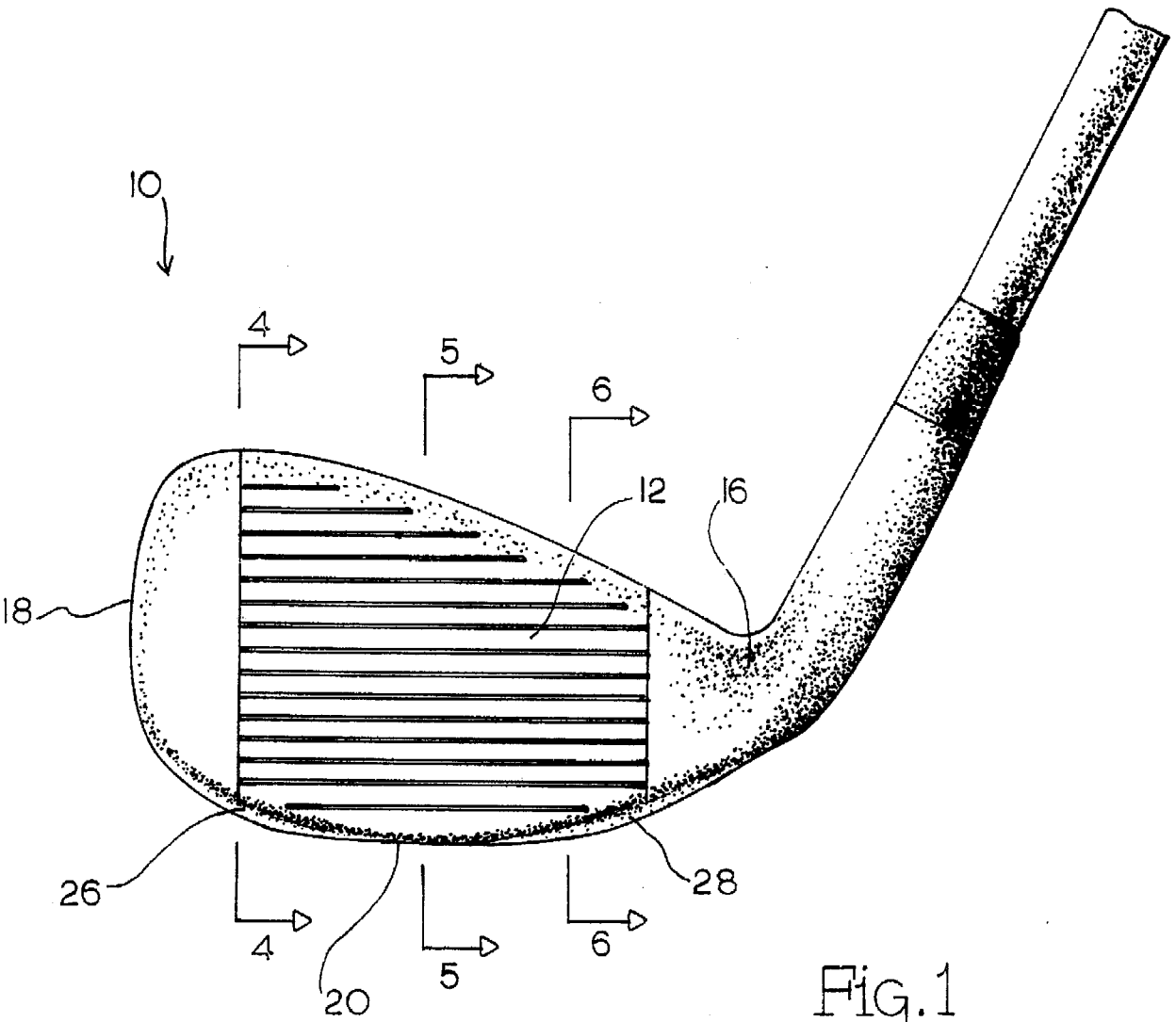
FIG. 1 is a front elevational view of the golf club head of the present invention.

With further reference to the drawings, the golf club head of the present invention is shown therein and indicated generally by the numeral 10. Golf club head 10 includes a face 12, back 14, heel area 16, and toe area 18.

Figure 3:
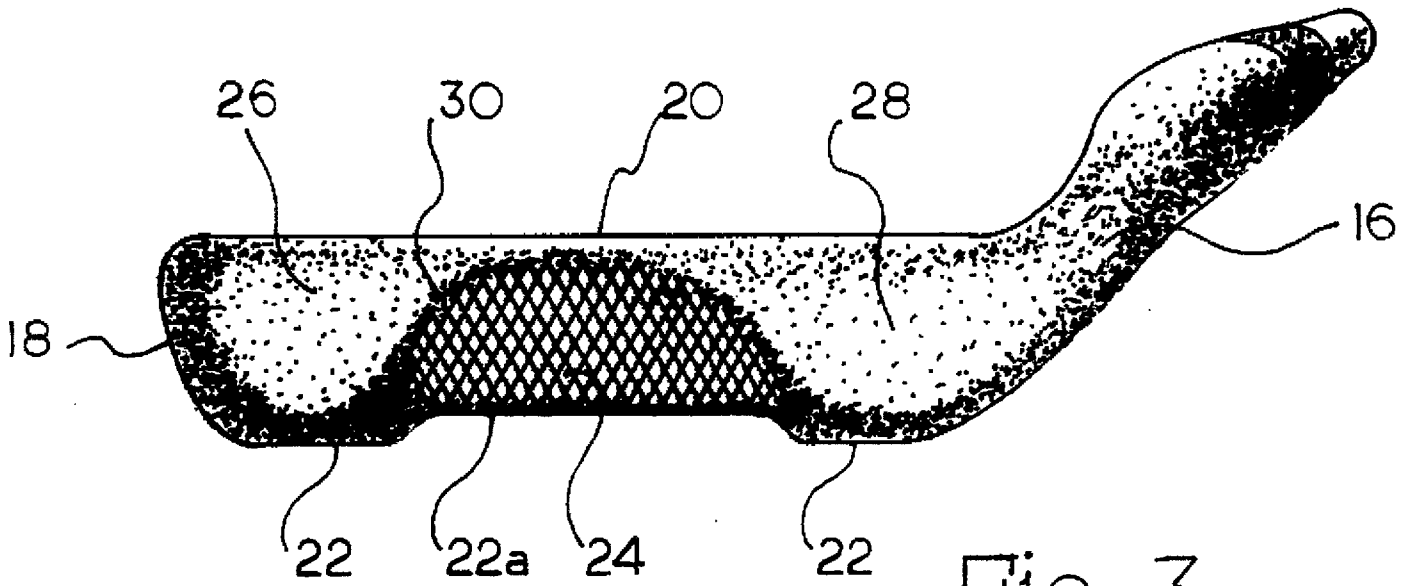
FIG. 3 is a plan view of the sole of the golf club head.
Figures 4, 5, 6:
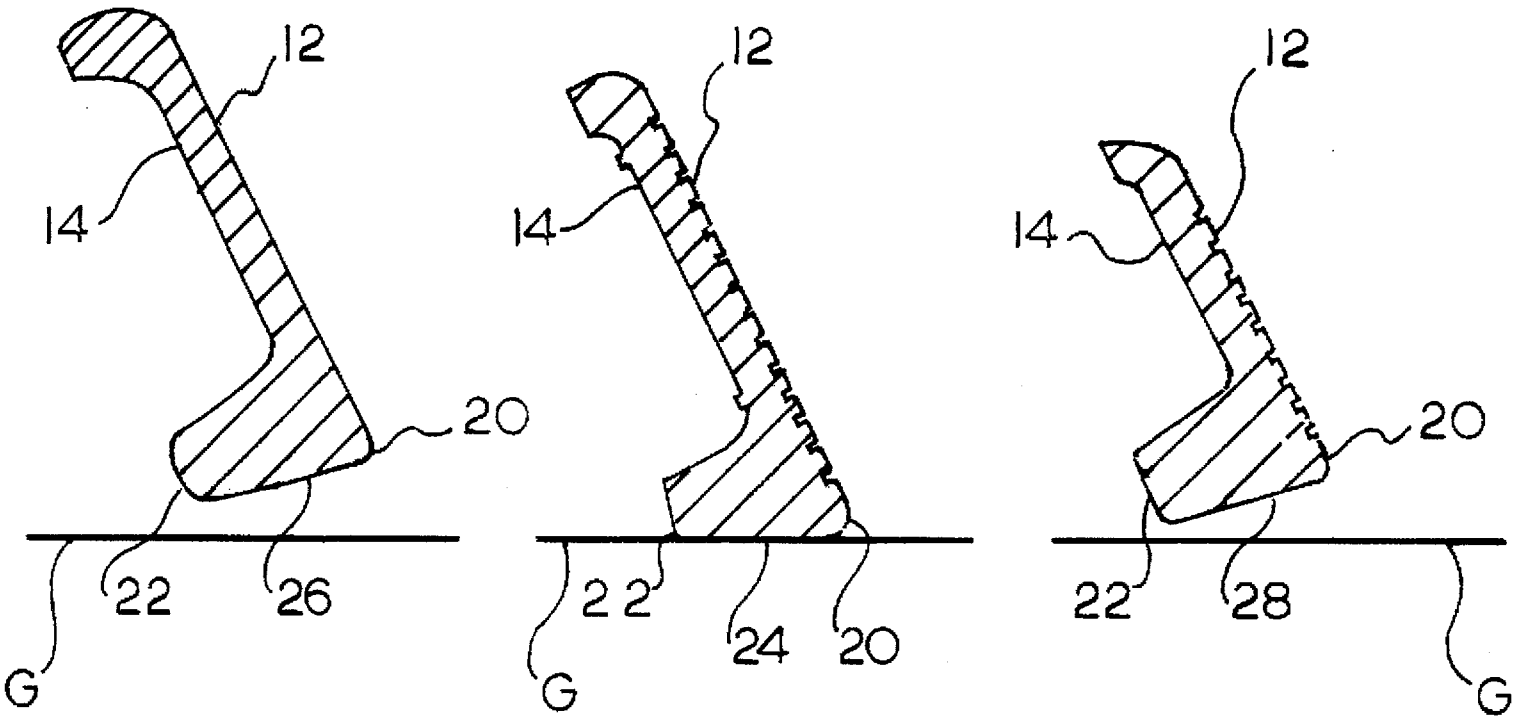
FIG. 4 is a sectional view taken through the line 4—4 of FIG. 1.
FIG. 5 is a sectional view taken through the line 5—5 of FIG. 1.
FIG. 6 is a sectional view taken through the line 6—6 of FIG. 1.

Formed about the bottom of the head 10 is a sole. The sole forms the bottom of the club head and generally extends between the heel area 16 and toe area 18. The sole of the golf club head 10 includes a series of distinct areas or surfaces. As illustrated in FIG. 3, the sole includes an intermediate surface 24 that is generally flat and as illustrated in FIG. 5, angles generally upwardly towards the back 14 of the golf club head 10 relative to the face 12 (FIG. 5). Disposed on opposite sides of the intermediate surface 24 is two other distinct surfaces referred to as outer surfaces 26 and 28. As indicated in FIG. 3, outer surface 26 is disposed adjacent the toe area 18 of the club head 10 while outer surface 28 is disposed adjacent the heel area 16 of the club head 10.

As seen in the drawings, the sole, comprised of the surfaces 24, 26 and 28 just described, lies between a leading edge 20 and a rear edge 22. As seen in FIGS. 1 and 3, the leading edge 20 is an edge defined by the intersection of face 12 and the front portion of the sole. The rear edge 22 refers to the rear edge of the sole.

Figure 2:
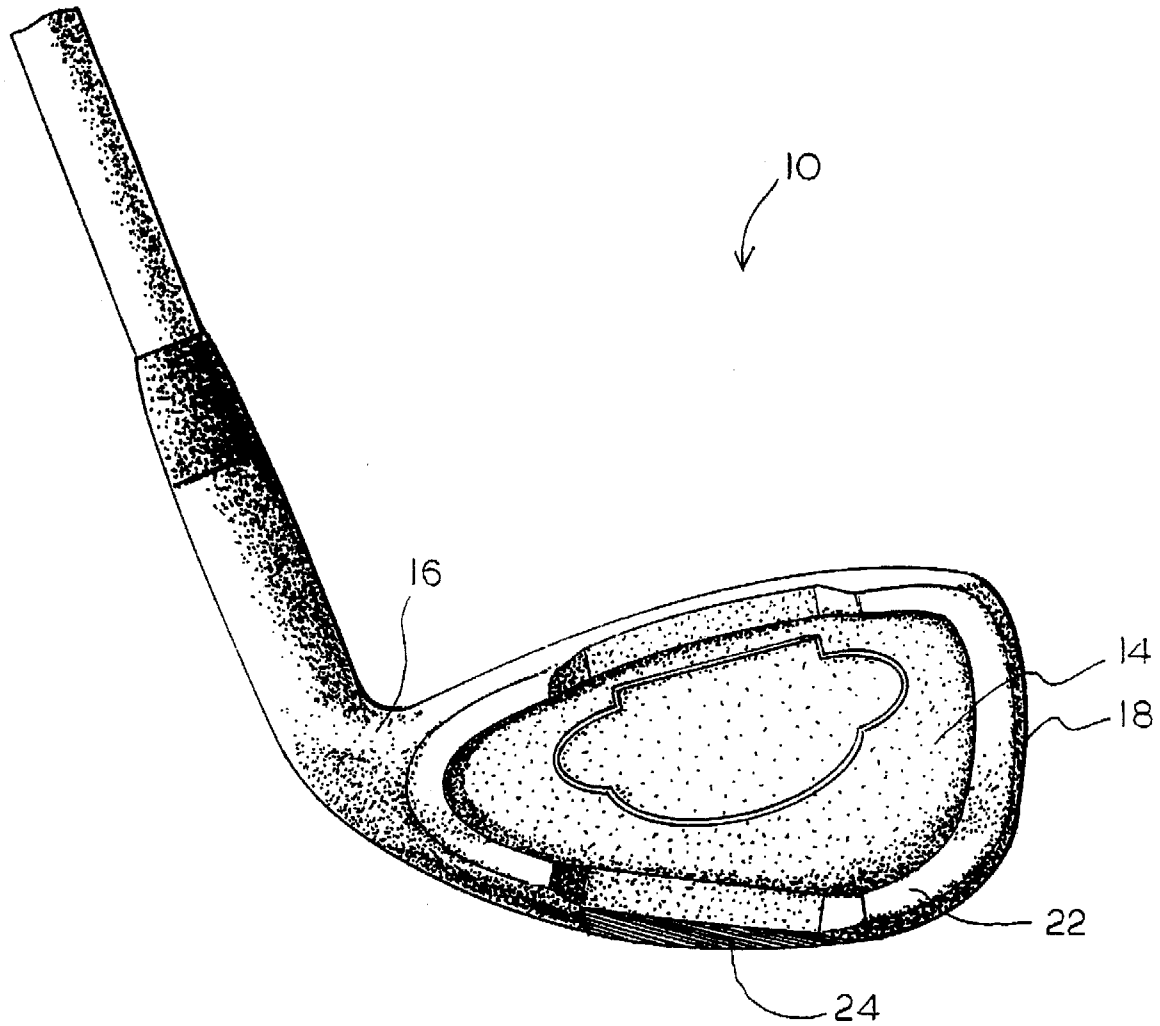
FIG. 2 is a back elevational view of the golf club head.

As noted above, the intermediate surface 24 and the outer surfaces 26 and 28 formed on the sole are distinct areas as the outer surfaces 26 and 28 do not lie in the same plane as the intermediate surface 24 but rather form distinct and discrete surfaces relative to the intermediate surface 24. In particular, the intermediate surface 24 forms a plateau on the sole. As the club 10 is oriented in FIGS. 1 and 2, the plateau of the intermediate surface 24 is disposed at a lower elevation than the outer surfaces 26 and 28. Outer surfaces 26 and 28 break away and extend from the plateau of the intermediate surface 24. For example, outer surface 26 is angled upwardly towards the leading edge 20 relative to the intermediate surface 24. At the same time, outer surface 26 is angled upwardly and outwardly towards the toe area 18 of the golf club head 10. Likewise, outer surface 28 is angled upwardly towards the leading edge 20 relative to the intermediate surface 24. Also, outer surface 28 is angled upwardly and outwardly from the intermediate surface 24 towards the heel area 16.

In the embodiment illustrated in FIG. 3, the intermediate surface 24 and the outer surfaces 26 and 28 of the sole are defined by and separated by a demarcation line 30. Demarcation line 30 extends from an area adjacent the rear edge 22 of the sole towards the leading edge 20 and generally curves across an area adjacent the leading edge 20 before the demarcation line 30 turns back and proceeds towards the rear edge 22 of the sole. Thus, it is seen in FIG. 3 that the intermediate surface 24 defined by the demarcation line 30 is of a generally U-shape. While the demarcation line 30 may be evident in the embodiment illustrated herein, it is contemplated that the sole of the golf club 10 with its respective distinct surfaces could be formed without the demarcation line 30 being evident or quite so evident as it is in the case of the design illustrated herein.

Leading edge 20, as seen in FIG. 1, is generally arcuate shaped and is consistent with the property of the two outer surfaces 26 and 28 being elevated with respect to the intermediate surface 24. Rear edge 22 of the sole also is at least slightly non-linear as it curves generally upwardly with the outer surfaces 26 and 28. In addition, the rear edge 22 of the sole includes a cut-out portion **22*a* disposed adjacent the rear or trailing edge of the intermediate surface 24**.

The sole and face 12 of the golf club head 10 form what is referred to as a face angle. In the case of the golf club head 10, the face angle varies as one moves from the heel area 16 to the toe area 18.

FIG. 5 illustrates a cross-sectional view of the golf club head 10 taken through the line 5—5 of FIG. 1. It is appreciated that this cross-sectional view is taken generally midway through the intermediate surface 24 of the sole. (In FIGS. 4, 5 and 6, G represents a reference or ground line). The face angle for this portion of the club head is illustrated by angle A in FIG. 8. Note that the face angle is formed by a construction line that is extended in co-planer relationship with the face 12 of the club and a second construction line that is extended from the sole generally tangential to the surface of the sole at an area adjacent the leading edge 20.

Figure 9:
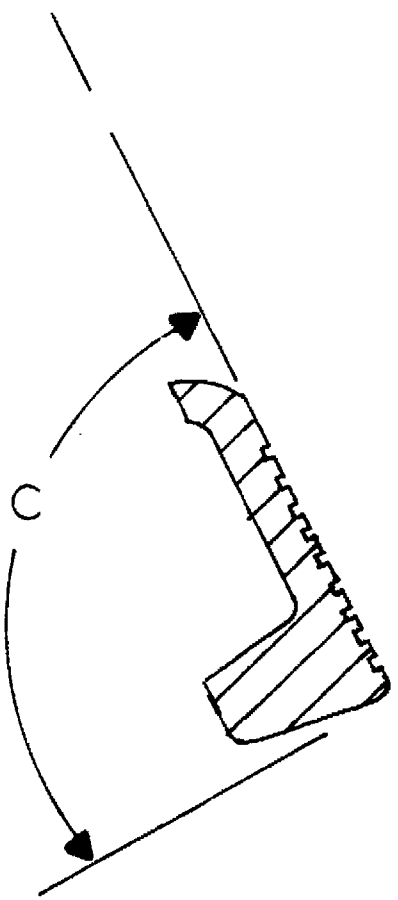
FIG. 9 illustrates the face angle formed by the face and sole of the golf club head at an area adjacent the heel area of the golf club head.
Figure 7:
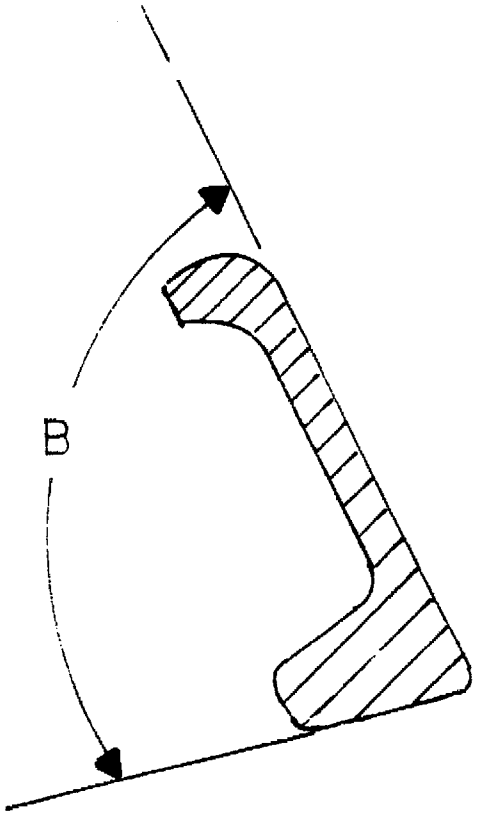
FIG. 7 illustrates the face angle formed by the face of the golf club head and the sole at an area adjacent the toe portion of the golf club head.

Now, turning to the face angles formed by the outer surfaces 26 and 28 of the sole, reference is made to FIGS. 4, 6, 7 and 9. Note that FIGS. 4 and 7 illustrate the outer surface 26 disposed adjacent the toe area 18 while FIGS. 6 and 9 illustrate the outer sole surface 28 disposed adjacent the heel area 16. In both cases, as illustrated in FIGS. 7 and 9, the face angles B and C are greater than the face angle A illustrated in FIG. 8. This is because in both cases, the outer surfaces 26 and 28 are inclined upwardly towards the leading edge 20 of the club relative to the intermediate surface 24.

Below in Table I is a summary of the face angles for angles A, B and C for a set of irons and wedges. Note that in the case of each club, that both face angles B and C exceed face angle A. As one proceeds from the 2 iron to the lob wedge, it is seen that the angle differential between face angle A and face angle B or C generally increases.

TABLE I

| CLUB | FACE ANGLE B | FACE ANGLE A | FACE ANGLE C |
|---|---|---|---|
| 2 iron | 85° | 72° | 86° |
| 3 iron | 85° | 69° | 85° |
| 4 iron | 80° | 66° | 80° |
| 5 iron | 80° | 62° | 80° |
| 6 iron | 77° | 60° | 77° |
| 7 iron | 77° | 60° | 77° |
| 8 iron | 75° | 57° | 75° |
| 9 iron | 74° | 53° | 70° |
| picking wedge | 72° | 53° | 70° |
| sand wedge | 70° | 49° | 64° |
| lob wedge | 64° | 43° | 55° |

Figure 8:
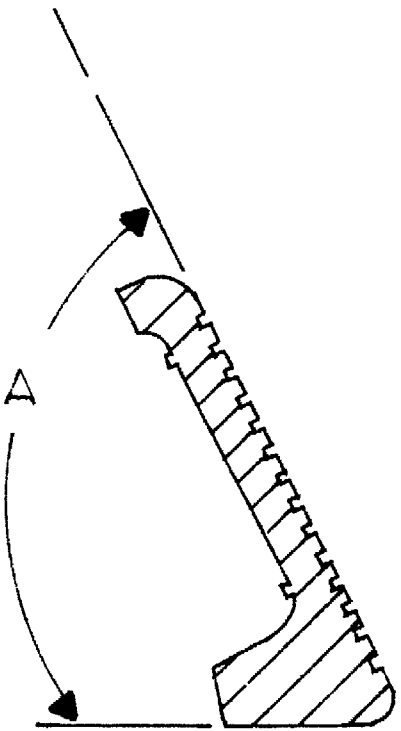
FIG. 8 illustrates the face angle formed by the face of the golf club head and the sole of the head at an intermediate area of the head.

As illustrated in FIGS. 7, 8 and 9, and in Table I, both face angles B and C are greater than face angle A which as pointed out previously represents the face angle in the area occupied by the intermediate surface 24. It is contemplated that in a preferred embodiment, that the face angles B and C would exceed the face angle A by approximately 13° to 21°.

By providing a sole for golf club head 10 according to the present invention, drag and resistance is reduced. In particular, outer surfaces 26 and 28 are elevated with respect to the intermediate surface 24 and consequently this reduces drag induced by the club as the same is swung through heavy, rough or tall grass. Likewise, the specific orientation and angling of the outer surfaces 26 and 28 tend to prevent the club from digging downwardly extensively into the turf or the ground. In fact, the outer surfaces 26 and 28 can be referred to as bounce angles as their particular orientation and disposition with respect to the intermediate surface 26 and to the golf club head 10 in general, tends to encourage the club to bounce or deflect away from the turf or ground as opposed to continuing into and through the turf or ground.

In forming the surfaces 26 and 28 (referred to as bounce angles) one is able to effectively remove weight from the sole of the golf club head. This weight can then be redistributed to other portions of the club head, forming a more solid club head and a more efficient use of weight.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A golf club head including a face, back, sole, and a leading edge formed adjacent the sole and face; the sole including a rear edge portion, an intermediate surface and a pair of outer surfaces disposed on opposite sides of the intermediate surface with the outer surfaces being generally elevated relative to the intermediate surface; and wherein in an address position the intermediate surface lies substantially horizontal while the outer surfaces project and extend upwardly, relative to the intermediate surface, from the rear edge portion of the sole to the leading edge of the club.

2. The golf club head of claim 1 wherein the intermediate and outer surfaces all form distinct surfaces.

3. The golf club head of claim 1 wherein the face angles formed between the outer surfaces and the face is greater than the face angle formed between the intermediate surface and the face.

4. The golf club head of claim 3 wherein each of the face angles formed by the outer surfaces exceed the face angle formed by the intermediate surface by approximately 13° to 21°.

5. The golf club head of claim 1 wherein the leading edge is generally curved shaped.

6. The golf club head of claim 5 wherein the leading edge extends generally downwardly adjacent one outer surface to a point adjacent the intermediate surface and then extends generally upwardly towards and by the other outer surface.

7. The golf club head of claim 1 including toe and heel areas and wherein the intermediate surface forms a plateau on the sole and wherein one outer surface on the sole breaks away from the plateau and angles upwardly towards the leading edge and the toe area while the other outer surface breaks away from the plateau and angles upwardly towards the leading edge and the heel area.

8. The golf club head of claim 7 wherein the intermediate surface includes a knurled surface while the outer two surfaces are generally smooth.

9. The golf club head of claim 1 wherein the sole includes a demarcation edge that extends across the sole and generally defines the intermediate and outer surfaces.

10. The golf club head of claim 9 wherein the demarcation line the extends across the sole is generally curved shaped.

11. The golf club head of claim 10 wherein the demarcation line extends generally from the rear edge of the sole, across the sole and towards the leading edge and thereafter turns back across the sole and extends back towards the rear edge.

12. The golf club head of claim 11 wherein the demarcation line is of a general U-shape.

13. A golf club head having a face, back, sole and a leading edge that extends adjacent the sole and the face; the sole including a rear edge portion, an intermediate surface and two outer surfaces with the two outer surfaces being elevated with respect to the intermediate surface; and wherein in an address position, the intermediate surface lies substantially horizontal while at least one of the outer surfaces projects and extends upwardly, relative to the intermediate surface, from the rear edge portion of the sole to the leading edge of the golf club head; and wherein the face angle formed between the at least one outer surface and the face is greater than the face angle formed between the intermediate surface and the face.

14. The golf club head of claim 13 wherein the face angle formed by the at least one outer surface exceeds the face angle of the intermediate surface by approximately 13° to 21°.

15. The golf club head of claim 13 wherein the leading edge is generally curved shaped.

16. The golf club head of claim 13 wherein the sole includes a demarcation line that extends across the sole and generally defines the intermediate and outer surfaces.

17. The golf club head of claim 16 wherein the demarcation line that extends across the sole is generally curve shaped.

18. The golf club head of claim 17 wherein the demarcation line extends generally from the rear edge of the sole, across the sole and towards the leading edge and thereafter turns back across the sole and extends back towards the rear edge.

19. A golf club head having a face, back, sole and a leading edge that forms an intersection between the sole and the face; the sole including a rear edge portion, an intermediate surface that forms a plateau and at least one outer surface; in an addressed position, the intermediate surface being substantially horizontal while the at least one outer surface breaks away from the intermediate plateau and extends upwardly relative to the intermediate surface and upwardly from the rear edge portion of the sole towards the leading edge of the golf club so as to for at least two distinct angled surfaces on the sole; and wherein the face angle formed between the outer surface and the face of the golf club head is greater than the face angle formed between the intermediate surface and the face of the golf club head.

20. The golf club head of claim 19 wherein the face angle formed by the at least one outer surface exceeds the face angle formed by the intermediate surface by approximately 13° to 21°.

21. The golf club head of claim 19 wherein the sole includes a demarcation line that extends across the sole and generally defines the intermediate and outer surfaces.

22. The golf club head of claim 21 wherein the demarcation line that extends across the sole is generally curve shaped.

23. The golf club head of claim 22 wherein the demarcation line extends generally from the rear edge of the sole, across the sole and towards the leading edge and thereafter turns back across the sole and extends back towards the rear edge.

* * * * *